US010256573B1

(12) United States Patent
Lin

(10) Patent No.: US 10,256,573 B1
(45) Date of Patent: Apr. 9, 2019

(54) NETWORK CONNECTOR ASSEMBLY WITH COMPENSATION MEANS

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/005,625

(22) Filed: Jun. 11, 2018

(51) Int. Cl.

| | |
|---|---|
| ***H01R 13/646*** | (2011.01) |
| ***H01R 13/6461*** | (2011.01) |
| ***H01R 13/502*** | (2006.01) |
| ***H01R 13/6474*** | (2011.01) |
| *H01R 13/03* | (2006.01) |
| *H01R 107/00* | (2006.01) |
| *H01R 24/64* | (2011.01) |

(52) U.S. Cl.
CPC ..... *H01R 13/6461* (2013.01); *H01R 13/502* (2013.01); *H01R 13/6474* (2013.01); *H01R 13/03* (2013.01); *H01R 24/64* (2013.01); *H01R 2107/00* (2013.01)

(58) Field of Classification Search
CPC ..... H01R 13/6461; H01R 13/6463; H01R 13/6467; H01R 13/502; H01R 13/5025; H01R 13/506; H01R 24/64; H01R 13/2474
See application file for complete search history.

(56) References Cited

U.S. PATENT DOCUMENTS

| | | | | |
|---|---|---|---|---|
| 5,571,035 | A * | 11/1996 | Ferrill | H01R 13/6461 439/676 |
| 5,628,647 | A | 5/1997 | Rohrbaugh et al. | |
| 6,007,368 | A | 12/1999 | Lorenz et al. | |
| 6,080,007 | A * | 6/2000 | Dupuis | H01R 13/6467 439/418 |
| 6,402,559 | B1 * | 6/2002 | Marowsky | H01R 13/6463 439/460 |
| 6,409,544 | B1 | 6/2002 | Wu | |
| 6,729,901 | B2 * | 5/2004 | Aekins | H01R 13/6463 439/418 |
| 6,811,445 | B2 * | 11/2004 | Caveney | H01R 13/514 439/676 |
| 6,837,738 | B1 * | 1/2005 | Chen | H01R 13/6477 439/418 |

(Continued)

*Primary Examiner* — Felix O Figueroa
(74) *Attorney, Agent, or Firm* — Guice Patents PLLC

(57) ABSTRACT

A network connector assembly includes a connection module having a housing having an opening on a rear side thereof and a plurality of elongated positioning grooves arranged in parallel on an opposing front side thereof, a wire bracket mounted in the housing near the opening and having a plurality of partition plates and a guide groove between each two adjacent partition plates, a contact holder mounted in the housing to face the wire bracket and including a base block, a plurality of positioning wire slots located on the base block corresponding to the positioning grooves and arranged at different elevations and a plurality of conducting contacts respectively mounted in the positioning wire slots and downwardly extended out of the positioning wire slots, a retainer block connected to the opening of the housing and providing a retaining plate, and a hollow cylindrical wire holder connected to the retainer block.

14 Claims, 6 Drawing Sheets

(56) References Cited

U.S. PATENT DOCUMENTS

| | | | | |
|---|---|---|---|---|
| 7,425,159 | B2 * | 9/2008 | Lin | H01R 13/6461 439/676 |
| 7,563,125 | B2 * | 7/2009 | Pepe | H01R 4/242 439/417 |
| 9,450,326 | B2 * | 9/2016 | Engels | H01R 13/502 |
| 9,847,607 | B2 * | 12/2017 | Bopp | H01R 13/42 |

* cited by examiner

NETWORK CONNECTOR ASSEMBLY WITH COMPENSATION MEANS

BACKGROUND OF THE INVENTION

1. Field of the Invention

The present invention relates to network connector technology and more particularly, to network connector assembly with compensation means.

2. Description of the Related Art

At present, the common design of a network line consists of four pairs of twisted copper cores, and these cores are distinguished and arranged in different colors. Currently in the network specification for the arrangement of the core line is to follow T568A or T568B line alignment. However, the common practice is that the line alignment is not arranged in sequence, especially the combination sequence of green twisted pairs and blue twisted pairs, which results in an occurrence of crosstalk.

In the current network socket module designs, in order to match the order of T568B line 1-8, the multiple gold pins in the module are also arranged in the order from 1 to 8, thus, crosstalk also occurs between the second and third pairs of twisted copper cores in the module. In order to eliminate crosstalk, many techniques have been disclosed.

For example, U.S. Pat. No. 5,628,647 an assembly of a multi-pair cable terminated by a modular plug for use in the transmission of high frequency signals that enables the core wires arranged in a staggered manner; U.S. Pat. No. 6,409,544 discloses a network data transmission cable connector in which the metal shield having a corrugated configuration adapted to separate the twisted pairs of the cable, for enabling the first, second and third twisted pairs of the cable to be separately supported above the metal shield and the two electrically insulated conductors of the fourth twisted pair of the cable to be separately supported below the metal shield. Further, U.S. Pat. No. 6,007,368 discloses a telecommunications connector with improved crosstalk reduction. According to this design, the configuration of the connector elements is complicated, making the fabrication difficult. If simply the PCB is designed for compensation to improve crosstalk reduction, the condensed circuit arrangement on the PCB will be difficult to achieve.

Further, due to that electrical characteristic emphasizes matchability and continuity of electrical transmission between the plug and the network route, it is not only for the compensation between the 36 pairs or the 45 pairs of the network jumpers. Further, adding a compensation mechanism to the PCB will also cause the increase in cost and will be unfavorable for market competition.

SUMMARY OF THE INVENTION

The present invention has been accomplished under the circumstances in view. It is the main object of the present invention to provide a network connector assembly, which has gold pins mounted in respective positioning wire slots that are disposed at different elevations so that the capacitive effect between adjacent core wires can be reduced to achieve reduction of crosstalk between core wires.

To achieve this and other objects of the present invention, a network connector assembly comprises a connection module and a communication module. The connection module comprises a housing, a wire bracket, a contact holder, a retainer block and a hollow cylindrical wire holder. The housing comprises an opening located on a rear side thereof, and a plurality of elongated positioning grooves arranged in parallel on an opposing front side thereof. The wire bracket is mounted in the housing near the opening of the housing, comprising a plurality of partition plates and a guide groove between each two adjacent partition plates. The contact holder is mounted in the housing to face toward the wire bracket, comprising a base block, a plurality of positioning wire slots located on one side of the base block corresponding to the respective positioning grooves and arranged at different elevations, and a plurality of conducting contacts respectively mounted in the positioning wire slots and downwardly extended out of the positioning wire slots. The retainer block is connected to the opening of the housing in series for direct communication and providing a retaining plate at a top side thereof. The hollow cylindrical wire holder is connected to a rear end of the retainer block opposite to the housing.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
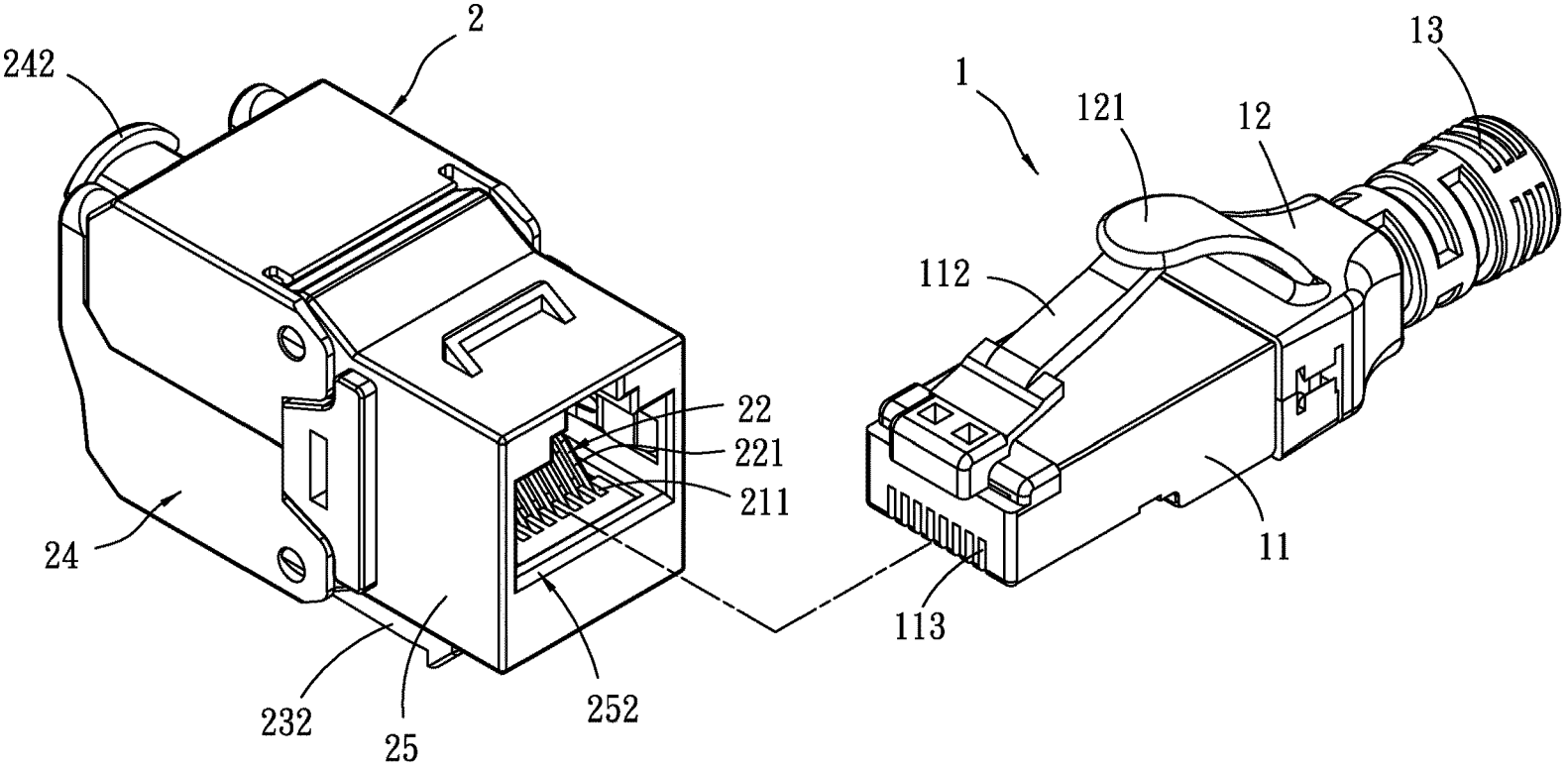
FIG. 1 is an exploded view of a network connector assembly in accordance with the present invention.

Referring to FIG. 1, a network connector assembly in accordance with the present invention is shown. The network connector assembly comprises a connection module 1 and a communication module 2. The connection module 1 is connected to the communication module 2. The connection module 1 comprises a housing 11 that is, as illustrated in FIG. 2, a hollow rectangular shell defining an opening 111 on a rear side thereof, a retainer block 12 that is a hollow trapezoidal shell connected to the opening 111 of the housing 11 in series for direct communication and providing a retaining plate 121 at a top side thereof, and a hollow cylindrical wire holder 13 connected to a rear end of the retainer block 12 opposite to the housing 11 for the insertion of a plurality of electrical wires (not shown) into the retainer block 12 and the housing 11.

Figure 2:
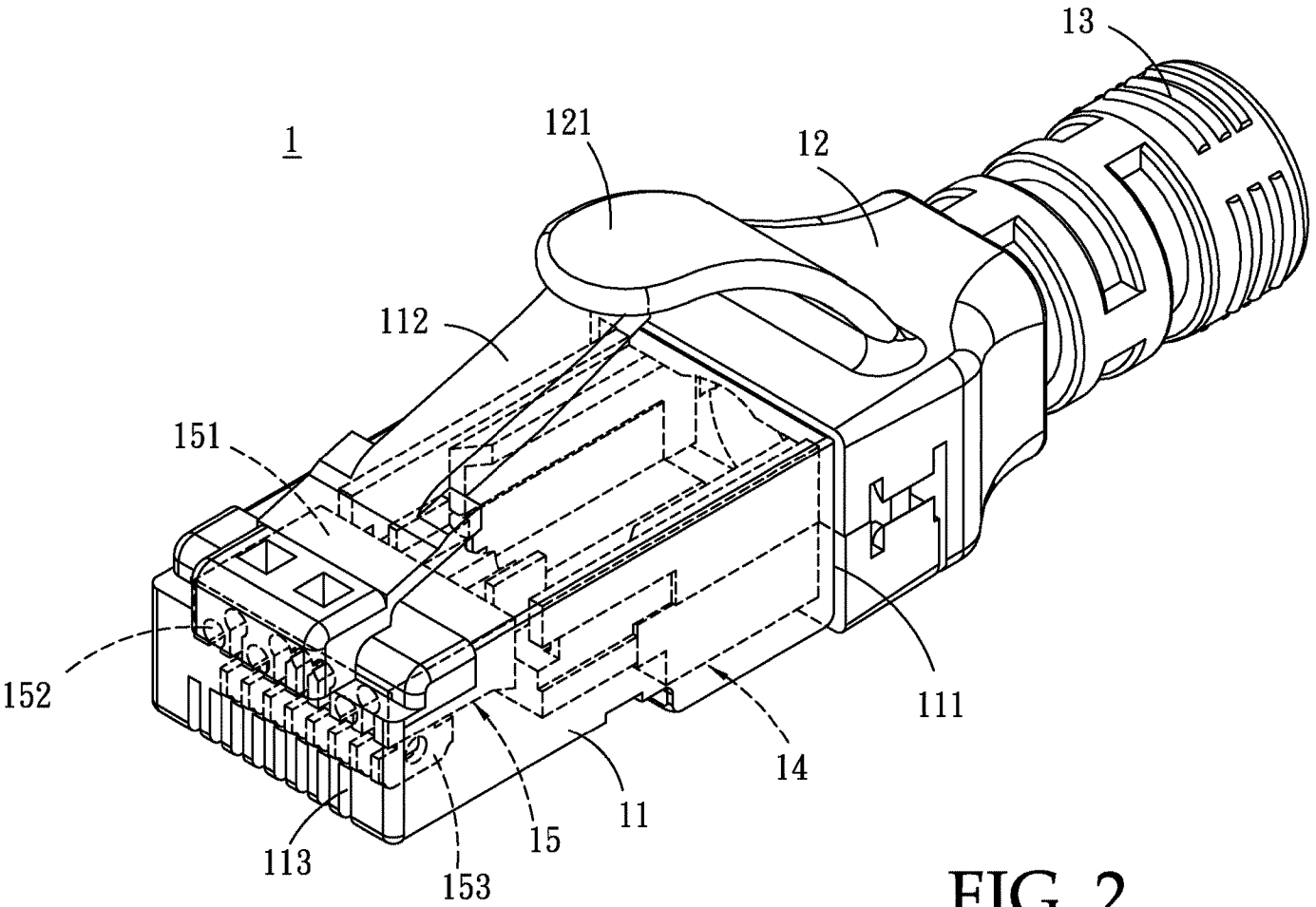
FIG. 2 is an elevational view of the connection module.
Figure 3:
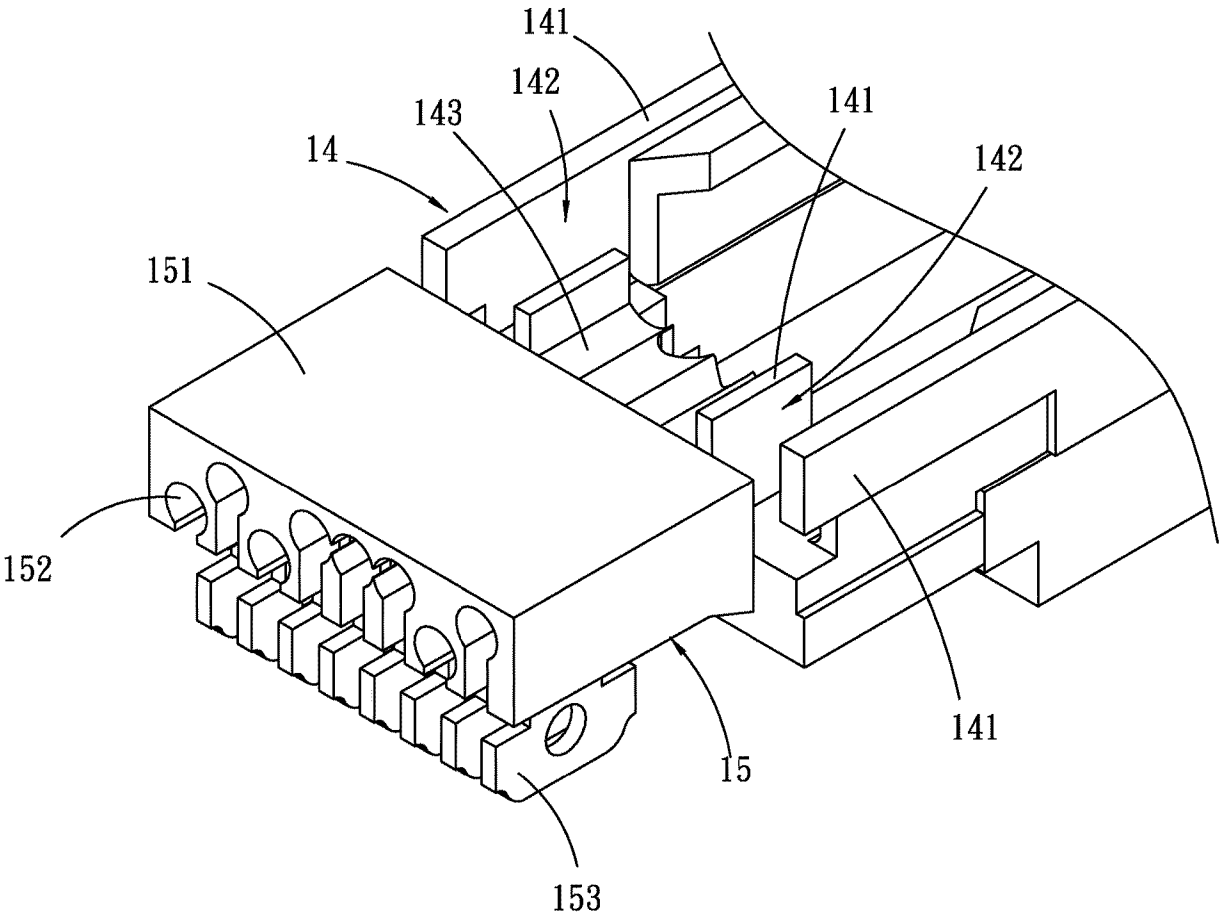
FIG. 3 is an elevational view of a part of the connection module.
Figure 4:
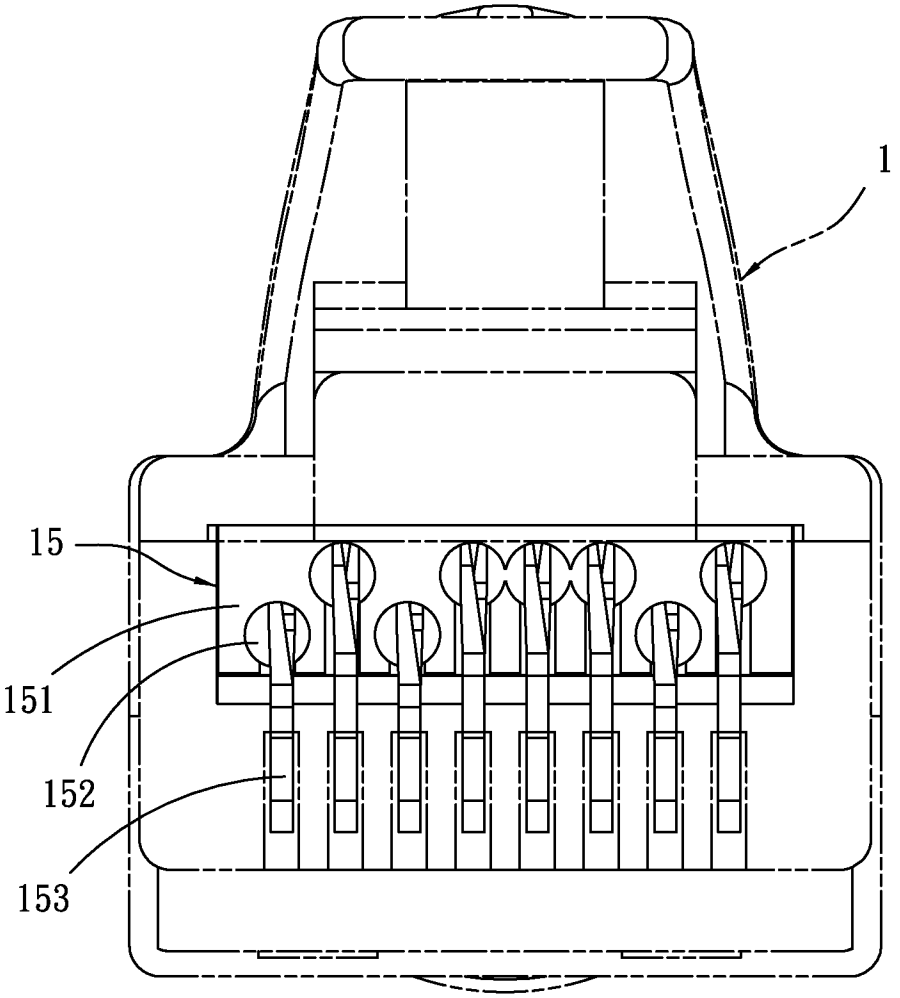
FIG. 4 is a front view of the connection module.

Referring to FIG. 2 and FIG. 1 again, the housing 11 comprises an elongated pressure plate 112 backwardly upwardly extended from a top side thereof in an oblique manner and stopped at a bottom side of a distal end of the retaining plate 121, a plurality of elongated positioning grooves 113 arranged in parallel on an opposing front side thereof, a wire bracket 14 mounted therein near the opening 111, and a contact holder 15 mounted therein to face toward the positioning grooves 113 and in line with the wire bracket 14. As illustrated in FIG. 3, the wire bracket 14 comprises a plurality of partition plates 141 arranged in parallel, a guide groove 142 defined between each two adjacent partition plates 141 for accommodating the inserted electrical wires, and a plurality of accommodation grooves 143 of arched cross section defined in the middle guide groove 142 for accommodating the inserted electrical wires. The contact holder 15 comprises a base block 151, and a plurality of positioning wire slots 152 located on one side thereof at different elevations and respectively aimed at the positioning grooves 113, and a plurality of conducting contact 153 respectively mounted in the positioning wire slots 152 in electric contact with the cores of the respective electrical wires that are positioned in the positioning grooves 113. As illustrated in the front view of FIG. 4, these positioning wire slots 152 are numbered from the first to the eighth wherein the positioning wire slots 152 located at the first, third, and seventh positions from left to right are at a low position; the positioning wire slots 152 located at the second, fourth, fifth, sixth and eighth positions are at a high position. The conducting contacts 153 have a T-shaped profile and are downwardly extended out of the respective positioning wire slots 152 to the same elevation. Thus, due to the effective of an elevational difference between the third and fourth positioning wire slots 152, the capacitive effect between the cores of the third and fourth electrical wires is reduced, and thus, crosstalk between the cores is relatively reduced.

Figure 5:
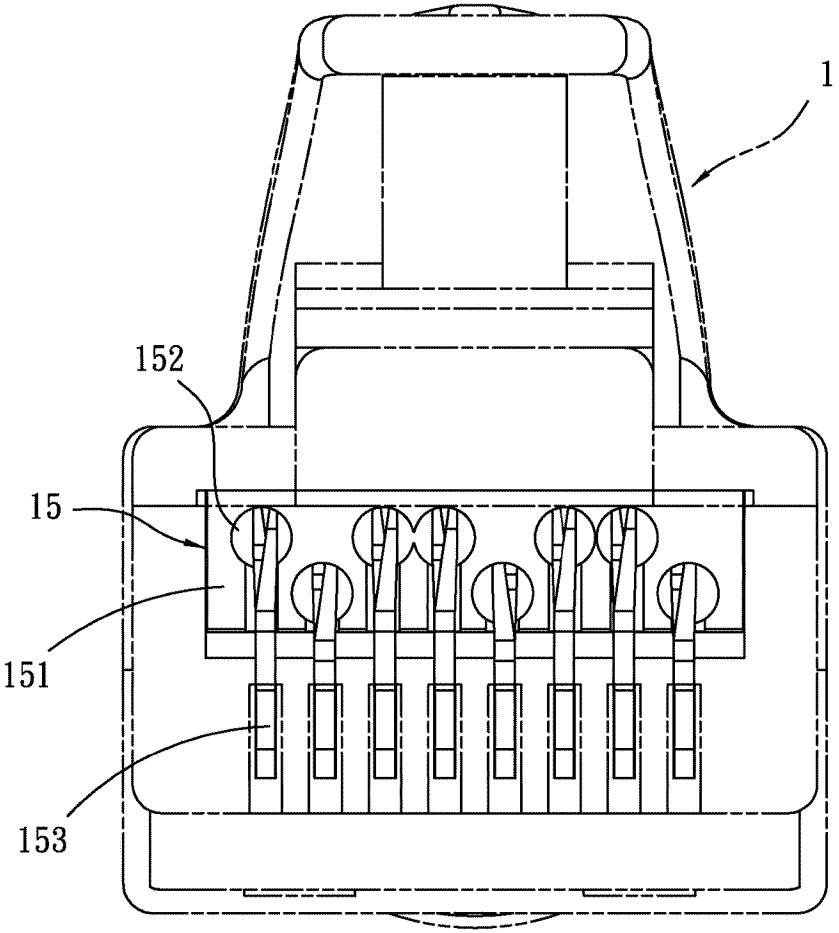
FIG. 5 is a front view of an alternate form of the connection module.

FIG. 5 illustrates an alternate form of the connection module 1 of the network connector assembly in accordance with the present invention. As illustrated, the positioning wire slots 152 located at the second, fifth and eighth positions from left to right are at a low position; the positioning wire slots 152 located at the first, third, fourth, sixth and seventh positions are at a high position. This arrangement also has the effect of reducing crosstalk between cores.

Figure 6:
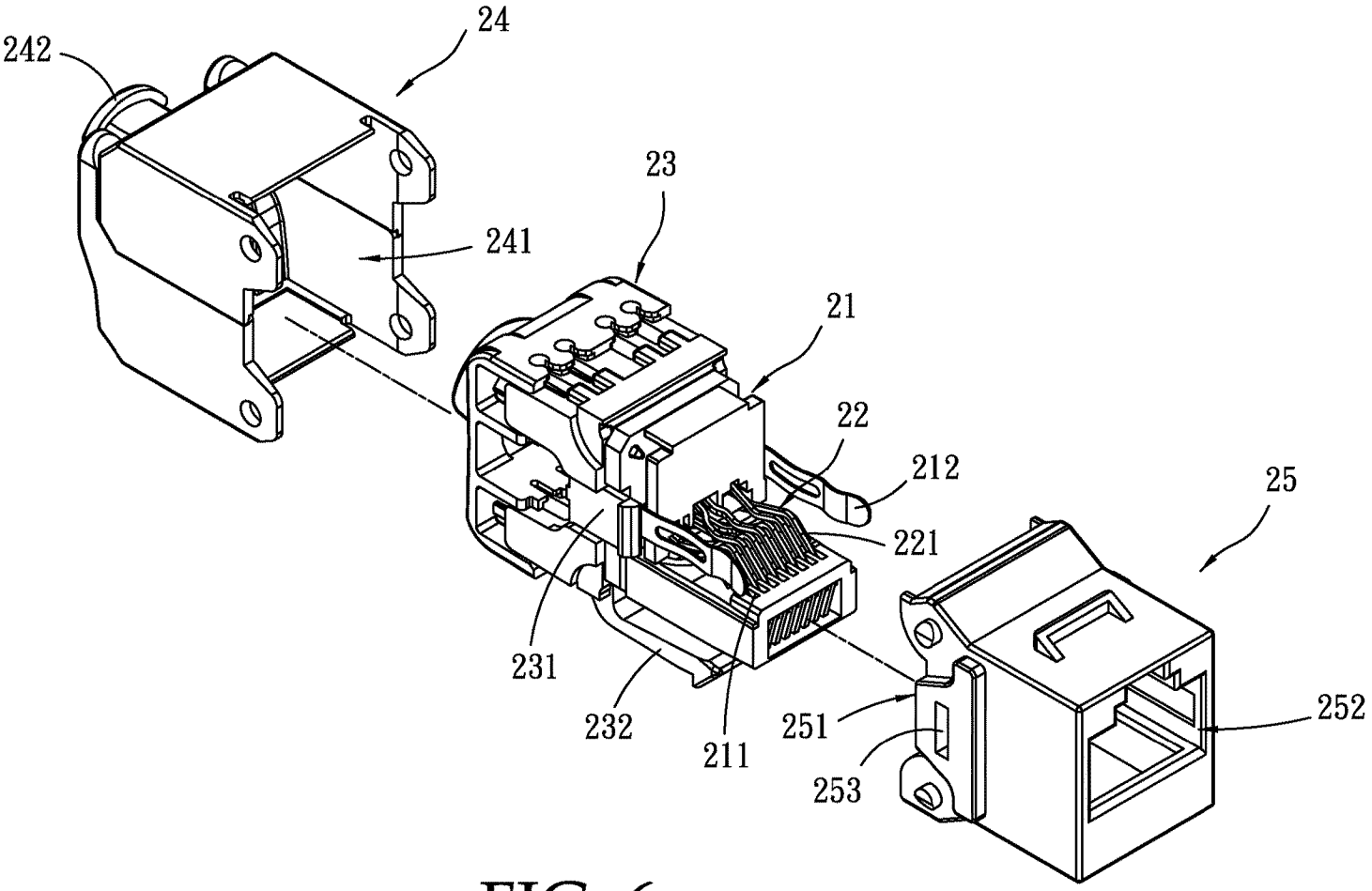
FIG. 6 is an exploded view of the communication module.

FIG. 6 is an exploded view of the communication module 2. As illustrated, the communication module 2 comprises a terminal block 21, a gold pin set 22, a guide block 23, a rear housing 24, and a front housing 25. The terminal block 21 comprises a plurality of positioning through holes 211, and two guard arms 212 respectively extended from two opposite lateral sides thereof. The gold pin set 22 is mounted in the terminal block 21, comprising a plurality of gold pins 221 corresponding to the respective positioning through holes 211 and exposed to the outside of the terminal block 21 and respectively positioned in the positioning grooves 113 and the positioning wire slots 152 for signal conduction after connection between the connection module 1 and the communication module 2. The guide block 23 is connected to a rear side of the terminal block 21, comprising two retaining plates 231 respectively extended from two opposite lateral sides thereof and a locating plate 232 disposed at a bottom side thereof and suspending below the terminal block 21. The rear housing 24 is a hollow shell mounted around the guide block 23, defining a front open side 241 and an opposing rear cable hole 242. The front open side 241 is adapted for accommodating the guide block 23. The rear cable hole 242 is adapted for the insertion of a cable (not shown) for connection with the gold pin set 22. The front housing 25 is a hollow shell mounted around the terminal block 21 comprising a rear mounting hole 251 and an opposing front plug hole 252. The rear mounting hole 251 is fastened to the terminal block 21 to hold the terminal block 21 inside the front housing 25 and to keep the gold pin set 22 in line with the front plug hole 252. The front housing 25 further comprises two retaining holes 253 respectively located on two opposite lateral sides thereof. After connection between the front housing 25 and the terminal block 21, the retaining plates 231 are respectively forced into engagement with the respective retaining holes 253 to secure the front housing 25, the terminal block 21 and the guide block 23 firmly together. At this time, the locating plate 232 of the guide block 23 is hooked on the bottom side of the front housing 25.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A network connector assembly, comprising a connection module, said connection module comprising:

a housing comprising an opening located on a rear side thereof, and a plurality of elongated positioning grooves arranged in parallel on an opposing front side thereof;

a wire bracket mounted in said housing near said opening of said housing, said wire bracket comprising a plurality of partition plates and a guide groove between each two adjacent said partition plates;

a contact holder mounted in said housing to face toward said wire bracket, said contact holder comprising a base block, a plurality of positioning wire slots located on one side of said base block corresponding to the respective said positioning grooves and arranged at different elevations and a plurality of conducting contacts respectively mounted in said positioning wire slots and downwardly extended out of said positioning wire slots;

a retainer block connected to said opening of said housing in series for direct communication and providing a retaining plate at a top side thereof; and a hollow cylindrical wire holder connected to a rear end of said retainer block opposite to said housing;

wherein said positioning wire slots are numbered from the first to the eighth in direction from left to right, the first, third and seventh said positioning wire slots being disposed at a low position, the second, fourth, fifth, sixth and eighth said positioning wire slots being disposed at a high position.

2. The network connector assembly as claimed in claim 1, wherein said housing further comprises an elongated pressure plate backwardly upwardly extended from a top side thereof in an oblique manner and stopped at a bottom side of a distal end of said retaining plate.

3. The network connector assembly as claimed in claim 1, wherein said wire bracket further comprises a plurality of accommodation grooves of arched cross section defined in one said guide groove that is disposed on the middle.

4. The network connector assembly as claimed in claim 1, wherein said conducting contacts have a T-shaped profile.

5. The network connector assembly as claimed in claim 1, further comprising a communication module connected to said connection module, said communication module comprising:

a terminal block comprising a plurality of positioning through holes and two guard arms respectively extended from two opposite lateral sides thereof;

a gold pin set mounted in said terminal block, said gold pin set comprising a plurality of gold pins respectively inserted through said positioning through holes and respectively accommodated in said positioning grooves and said positioning wire slots for signal communication after connection between said connection module and said communication module;

a guide block connected to said terminal block, said guide block comprising two retaining plates respectively extended from two opposite lateral sides thereof and a locating plate disposed at a bottom side thereof and suspending below said terminal block;

a rear housing mounted around said guide block, said rear housing comprising a front open side adapted for accommodating said guide block and an opposing rear cable hole adapted for the insertion of a cable; and a front housing mounted around said terminal block, said front housing comprising a rear mounting hole and an opposing front plug hole, said rear mounting hole being fastened to said terminal block to hold said terminal block inside said front housing and to keep said gold pin set in line with said front plug hole.

6. The network connector assembly as claimed in claim 5, wherein said front housing further comprises two retaining holes respectively located on two opposite lateral sides thereof for the engagement of the respective said retaining plates of said guide block after connection between said front housing and said terminal block.

7. The network connector assembly as claimed in claim 5, wherein said locating plate of said terminal block is hooked in a bottom side of said front housing.

8. A network connector assembly, comprising a connection module, said connection module comprising:

a housing comprising an opening located on a rear side thereof, and a plurality of elongated positioning grooves arranged in parallel on an opposing front side thereof;

a wire bracket mounted in said housing near said opening of said housing, said wire bracket comprising a plurality of partition plates and a guide groove between each two adjacent said partition plates;

a contact holder mounted in said housing to face toward said wire bracket, said contact holder comprising a base block, a plurality of positioning wire slots located on one side of said base block corresponding to the respective said positioning grooves and arranged at different elevations and a plurality of conducting contacts respectively mounted in said positioning wire slots and downwardly extended out of said positioning wire slots;

a retainer block connected to said opening of said housing in series for direct communication and providing a retaining plate at a top side thereof; and a hollow cylindrical wire holder connected to a rear end of said retainer block opposite to said housing;

wherein said positioning wire slots are numbered from the first to the eighth in direction from left to right, the second, fifth and eighth said positioning wire slots being disposed at a low position, the first, third, fourth, sixth and seventh said positioning wire slots being disposed at a high position.

9. The network connector assembly as claimed in claim 8, wherein said housing further comprises an elongated pressure plate backwardly upwardly extended from a top side thereof in an oblique manner and stopped at a bottom side of a distal end of said retaining plate.

10. The network connector assembly as claimed in claim 8, wherein said wire bracket further comprises a plurality of accommodation grooves of arched cross section defined in one said guide groove that is disposed on the middle.

11. The network connector assembly as claimed in claim 8, wherein said conducting contacts have a T-shaped profile.

12. The network connector assembly as claimed in claim 8, further comprising a communication module connected to said connection module, said communication module comprising:

a terminal block comprising a plurality of positioning through holes and two guard arms respectively extended from two opposite lateral sides thereof;

a gold pin set mounted in said terminal block, said gold pin set comprising a plurality of gold pins respectively inserted through said positioning through holes and respectively accommodated in said positioning grooves and said positioning wire slots for signal communication after connection between said connection module and said communication module;

a guide block connected to said terminal block, said guide block comprising two retaining plates respectively extended from two opposite lateral sides thereof and a locating plate disposed at a bottom side thereof and suspending below said terminal block;

a rear housing mounted around said guide block, said rear housing comprising a front open side adapted for accommodating said guide block and an opposing rear cable hole adapted for the insertion of a cable; and a front housing mounted around said terminal block, said front housing comprising a rear mounting hole and an opposing front plug hole, said rear mounting hole being fastened to said terminal block to hold said terminal block inside said front housing and to keep said gold pin set in line with said front plug hole.

13. The network connector assembly as claimed in claim 12, wherein said front housing further comprises two retaining holes respectively located on two opposite lateral sides thereof for the engagement of the respective said retaining plates of said guide block after connection between said front housing and said terminal block.

14. The network connector assembly as claimed in claim 12, wherein said locating plate of said terminal block is hooked in a bottom side of said front housing.

* * * * *